US010221539B2

(12) United States Patent
Mathis et al.

(10) Patent No.: US 10,221,539 B2
(45) Date of Patent: Mar. 5, 2019

(54) SYSTEM AND METHOD FOR FOUNDATION OF WELLHEADS

(71) Applicant: NeoDrill AS, Ålgård (NO)

(72) Inventors: Wolfgang Mathis, Sandnes (NO); Harald Strand, Ålgård (NO)

(73) Assignee: NeoDrill AS, Ålgård (NO)

( * ) Notice: Subject to any disclaimer, the term of this patent is extended or adjusted under 35 U.S.C. 154(b) by 0 days.

(21) Appl. No.: 15/778,427

(22) PCT Filed: Nov. 24, 2016

(86) PCT No.: PCT/NO2016/050237

§ 371 (c)(1),
(2) Date: May 23, 2018

(87) PCT Pub. No.: WO2017/091084

PCT Pub. Date: Jun. 1, 2017

(65) Prior Publication Data

US 2018/0347140 A1 Dec. 6, 2018

(30) Foreign Application Priority Data

| | | |
|---|---|---|
| Nov. 25, 2015 | (NO) | 20151608 |
| Jun. 29, 2016 | (NO) | 20161083 |
| Nov. 17, 2016 | (NO) | 20161815 |

(51) Int. Cl.
*E02D 27/10* (2006.01)
*E21B 33/035* (2006.01)
(Continued)

(52) U.S. Cl.
CPC ..... *E02D 27/18* (2013.01); *E02D 27/50* (2013.01); *E21B 33/043* (2013.01); *E21B 41/08* (2013.01)

(58) Field of Classification Search
CPC ..... E02D 27/18; E02D 27/50; E21B 33/043; E21B 41/08
See application file for complete search history.

(56) References Cited

U.S. PATENT DOCUMENTS 3,667,547 A * 6/1972 Ahlstone ..... E21B 33/043 166/286
3,673,716 A * 7/1972 Trondle ..... E02F 3/9231 37/322
(Continued)

FOREIGN PATENT DOCUMENTS

NO 313340 9/2002
WO 2010068119 6/2010
(Continued)

OTHER PUBLICATIONS

Norwegian Search Report, Norwegian Patent Application No. 20151608, dated Jun. 21, 2016.
(Continued)

*Primary Examiner* — Benjamin F Fiorello
(74) *Attorney, Agent, or Firm* — Andrus Intellectual Property Law, LLP

(57) ABSTRACT

A wellhead foundation is for one or more subsea wells. The wellhead foundation has a suction foundation with a housing with an open bottom and a top which is closable with a top cover, and one or more pipes being attached to the housing and extending from the top of the housing and at least over a substantial part of the vertical extent of the housing and away from the housing at least in a vertical direction. A straight upper part of each pipe projects up above the top of the housing and forms an upper conductor-casing portion which is arranged to receive the upper well-pipe portion and forms part of a low-pressure barrier in the well. The straight upper pipe portion of each pipe is arranged parallel to the
(Continued)

center axis of the housing. A method of establishing a subsea wellhead foundation is described as well.

16 Claims, 5 Drawing Sheets

(51) Int. Cl.

| | |
|---|---|
| ***E02D 27/18*** | (2006.01) |
| ***E21B 33/043*** | (2006.01) |
| ***E02D 27/50*** | (2006.01) |
| *E21B 41/08* | (2006.01) |

(56) References Cited

U.S. PATENT DOCUMENTS

| | | | | |
|---|---|---|---|---|
| 4,334,584 | A * | 6/1982 | Magill | E21B 7/12 175/171 |
| 4,558,744 | A * | 12/1985 | Gibb | E21B 33/037 166/222 |
| 6,659,182 | B1 | 12/2003 | Saugier et al. | |
| 8,122,618 | B2 * | 2/2012 | Van Rompay | E02F 3/88 37/195 |
| 2003/0029620 | A1 | 2/2003 | Strand | |
| 2012/0003048 | A1 * | 1/2012 | Hosoy | B63B 21/27 405/172 |
| 2013/0220206 | A1 | 8/2013 | Moeged et al. | |
| 2014/0069657 | A1 | 3/2014 | Povloski | |

FOREIGN PATENT DOCUMENTS

| | | |
|---|---|---|
| WO | 2012123431 | 9/2012 |
| WO | 2013167872 | 11/2013 |
| WO | 2014116119 | 7/2014 |
| WO | 2015054766 | 4/2015 |
| WO | 2015118348 | 8/2015 |

OTHER PUBLICATIONS

Norwegian Search Report, Norwegian Patent Application No. 20161083, dated Jan. 23, 2017.

Norwegian Search Report, Norwegian Patent Application No. 20161815, dated Jun. 13, 2017.

International Search Report, PCT/NO2016/050237, dated Feb. 1, 2017.

Written Opinion, PCT/NO2016/050237, dated Feb. 1, 2017.

* cited by examiner

SYSTEM AND METHOD FOR FOUNDATION OF WELLHEADS

CROSS-REFERENCE TO RELATED APPLICATIONS

This application is the U.S. national stage application of International Application PCT/NO2016/050237, filed Nov. 24, 2016, which international application was published on Jun. 1, 2017, as International Publication WO 2017/091084 in the English language. The International Application claims priority of Norwegian Patent Application No. 20151608, filed Nov. 25, 2015, Norwegian Patent Application No. 20161083, filed Jun. 29, 2016 and Norwegian Patent Application No. 20161815, filed Nov. 17, 2016. The international application and Norwegian application are all incorporated herein by reference, in entirety.

FIELD

The invention relates to a wellhead foundation for subsea wells, the wellhead foundation comprising a suction foundation provided with a housing with an open bottom and a top which is closable with a top cover, and one or more low-pressure-barrier pipes extending through the top cover and, at least in the operative position of the suction foundation, beyond the vertical or horizontal extent of the housing. The invention also relates to a method of establishing a subsea wellhead foundation.

BACKGROUND

The establishment of a subsea well, for example a petroleum well, is conditional on a wellhead, which is arranged on the seabed, being stabilized in such a way that strain, for example lateral forces, to which the wellhead Christmas tree is subjected because of currents in the surrounding water masses is transmitted to the seabed masses surrounding the top part of the wellbore. The stabilization is typically provided by a conductor casing, which defines the top part of the wellbore against the surrounding unconsolidated masses, being cemented against the unconsolidated masses after, for example, the conductor casing has been lowered into a drilled hole or been driven down into the unconsolidated masses by an impacting device. The conductor casing forms a low-pressure barrier in the well and is connected to a low-pressure housing in the wellhead. Through the conductor casing and further through an established borehole a well pipe that forms a high-pressure barrier in the well is extended.

An improved stabilization is achieved by the wellhead being provided with a well frame, which is supported on the seabed. The applicant's own suction foundation (Conductor Anchor Node=CAN) as described in NO 313340 B1 and the corresponding US2003029620 A1 provides a larger contact area between the upper part of the conductor casing and the surrounding seabed mass in order thereby to further increase the stability of the wellhead. Preferably, the conductor casing is extended through a supporting pipe, which is typically centered in the suction foundation and secured to the top cover of the suction foundation and to a lower portion of the skirt of the suction foundation.

The establishing of a wellhead is laborious and especially the installation of a conductor casing may result in unconsolidated masses around the conductor casing and wellhead foundation being washed out. The risk of such washouts occurring depends on several factors, among them the properties of the unconsolidated masses. Measures are therefore needed in order to reduce the risk of such washouts.

There is also a need to be able to establish several wellheads on the same foundation without this resulting in the foundation having to have a size, which makes the installation unduly demanding because of the dimension and weight.

WO2015054766 discloses the installation of conductor casings, that is to say a low-pressure barrier, in a seabed, with an assembly of one or more suction foundations with one or more integrated pipes extending in the full height of the suction foundation, inside or on the outside of the suction foundation(s) and projecting up above the top of the suction foundation(s). The suction foundation(s) is/are provided with top cover(s) closing the top(s) of the suction foundation(s).

WO2015118348 discloses an apparatus for installing a wellbore in a seabed, in which the upper end of the suction foundation is provided with a wellhead for engagement with a conductor casing, that is to say a low-pressure barrier, extending through the housing of the suction foundation.

SUMMARY

The invention has for its object to remedy or reduce at least one of the drawbacks of the prior art or at least provide a useful alternative to the prior art.

The object is achieved through the features that are specified in the description below and in the claims that follow.

A wellhead foundation is provided for subsea wells for the exploration for or/and production of petroleum, for example, or for the injection of gas or water, for example. The wellhead foundation comprises a suction foundation in which a housing is provided with an open bottom and a top cover, which, at least during the installation of the suction foundation, closes the top of the suction foundation. The ground plan of the housing may be circular, elliptical, oval or polygonal. The wall(s) of the housing is/are tight, so that a negative pressure may be created inside the housing. In the suction foundation, at least one pipe is arranged, which is arranged to form an upper conductor-casing portion for receiving the upper well-pipe portion and form part of a low-pressure barrier in the well. Said pipe extends from the top of the housing and at least over a substantial part of the vertical extent of the housing away from the housing at least in a vertical direction, that is to say beyond the open bottom of the housing and/or outwards from the wall of the housing. An upper portion of said pipe is straight and is preferably standing vertically when the suction foundation is positioned in a seabed, the straight pipe portion lying substantially parallel to the center axis of the suction foundation. A portion of the pipe lying below may be straight or deflected. A deflected pipe may extend through an opening in the wall of the housing. If said pipe extends through the top cover of the housing and/or through the wall of the housing, the top cover and the wall fit tightly around the pipe. Said pipe is braced against the housing. The suction foundation is provided, in a manner known per se, with at least one connection for a suction line, for the internal space of the suction foundation to be evacuated so that surrounding water masses can drive the suction foundation down into unconsolidated masses in a seabed.

In the operative state of the suction foundation, said pipe has a length, which is adapted to the properties of the unconsolidated masses into which the suction foundation is going to be set. If said pipe does not extend beyond the open lower end of the housing during transport, the transport and deployment of the suction foundation may be simplified, as, in this embodiment, the suction foundation may be transported upright on a vessel deck. Since, in an operative state, said pipe is going to have a length extending beyond the horizontal and/or vertical extent(s) of the suction foundation, said pipe may be formed in various ways. In one embodiment, said pipe may be manufactured with the desired, fixed length and be attached to the housing. In this embodiment it is the most obvious to transport the suction foundation lying down. In another embodiment said pipe may be formed as a telescopic pipe which is extended while or after the suction foundation is being/has been put down, for example while the suction foundation is hanging from a lifting device on an installation vessel or by the use of an underwater hammer after the suction foundation has been driven into the unconsolidated masses. A further way of providing a lengthened pipe is to join an extension to the pipe while the suction foundation is placed in an upright position, hanging from a lifting device on an installation vessel, possibly standing on a framework projecting from the hull of the vessel or across a moon pool of the vessel.

When installing a suction foundation with one or more lengthened pipes, it is an advantage if boreholes that can accommodate at least some of the straight pipes have been established in the unconsolidated masses. In unconsolidated masses having the right properties, the pipes may be driven down into the unconsolidated masses by the weight of the suction foundation and the water pressure on the evacuated suction foundation. This may also apply to deflected pipes.

An advantage of the present invention is that several wellheads may be established on a suction foundation in that several well pipes may be placed with good spacing near and within the periphery of the suction foundation, possibly also outside the periphery of the suction foundation, and the well pipes may be given a deflection even before they leave the suction foundation. In addition, the connection between the upper portion of the conductor casing and the suction foundation may be optimized, as there is easy access to the connecting portions while the wellhead foundation is being made.

When a pipe extends down below the skirt of the suction foundation or outwards from the wall of the suction foundation, the pipe may be provided with a weakening inside the portion that is inside or at the periphery of the suction foundation to simplify a shutting down and abandoning of the well(s). Such a weakening may result in the suction foundation being easier to pull up and recover.

The invention is defined by the independent claims. The dependent claims define advantageous embodiments of the invention.

In a first aspect, the invention relates more specifically to a wellhead foundation for one or more subsea wells, the wellhead foundation comprising a suction foundation provided with a housing with an open bottom and a top which is closable with a top cover, and one or more pipes being attached to the housing and extending from the top of the housing and at least over a substantial part of the vertical extent of the housing and away from the housing at least in a vertical direction, characterized by

- a straight upper portion of each pipe projecting up above the top of the housing and forming an upper conductor-casing portion which is arranged to receive an upper well-pipe portion and forms part of a low-pressure barrier in the well, and
- the straight upper pipe portion of each pipe being arranged parallel to the center axis of the housing.

The straight upper pipe portion of said pipe may be arranged eccentrically in the suction foundation.

A deflected pipe may extend through the top cover and through a wall opening in the housing, the wall opening fitting tightly against the periphery of the deflected pipe.

Alternatively, a deflected pipe may extend through the top cover and beyond a skirt edge of the housing.

The pipe may be lengthenable.

The pipe may be telescopingly lengthenable by means of one or more telescope sections. Alternatively, the pipe may be joinably lengthenable by means of one or more pipe sections.

Several pipes may be distributed inside and/or outside the periphery of the housing.

At least one straight or deflected pipe may be arranged outside of the periphery of the housing.

The housing may be provided with several internal walls that form several separate chambers, which are each provided with a suction-line connection.

In a second aspect, the invention relates more specifically to a method of establishing a subsea wellhead foundation, the method comprising the steps of

- providing a suction foundation as described above;
- placing the suction foundation in an upright position over a location on a seabed for establishing one or more subsea wells, characterized by the method including the further steps of

- bringing a skirt edge of the suction foundation into abutment on the seabed;
- driving one or more pipes attached to a suction-foundation housing and a skirt of the suction-foundation housing down into an unconsolidated mass, said pipe(s) projecting up above the top of the housing and forming an upper conductor-casing portion, which is arranged to receive an upper well-pipe portion and forms part of a low-pressure barrier in the wells.

The method may include the further step of

- before the suction foundation is brought into abutment against the seabed, lengthening at least one of the pipes.

The method may include the further step of

- after the suction foundation has been set into the seabed, lengthening at least one of the pipes.

The method may include the further step steps of

- before the suction foundation is driven down into the unconsolidated mass, forming a borehole/boreholes in the unconsolidated mass, corresponding to one or more straight pipes integrated in the suction foundation;
- placing the suction foundation on the seabed in such an orientation that the straight pipe or pipes are arranged over the respective boreholes; and
- moving the straight pipes down into the respective boreholes by driving the skirt of the housing down into the unconsolidated mass.

BRIEF DESCRIPTION OF THE DRAWINGS

In what follows, examples of preferred embodiments are described, which are illustrated in the accompanying drawings, in which.

DETAILED DESCRIPTION OF THE DRAWINGS

Figure 1:
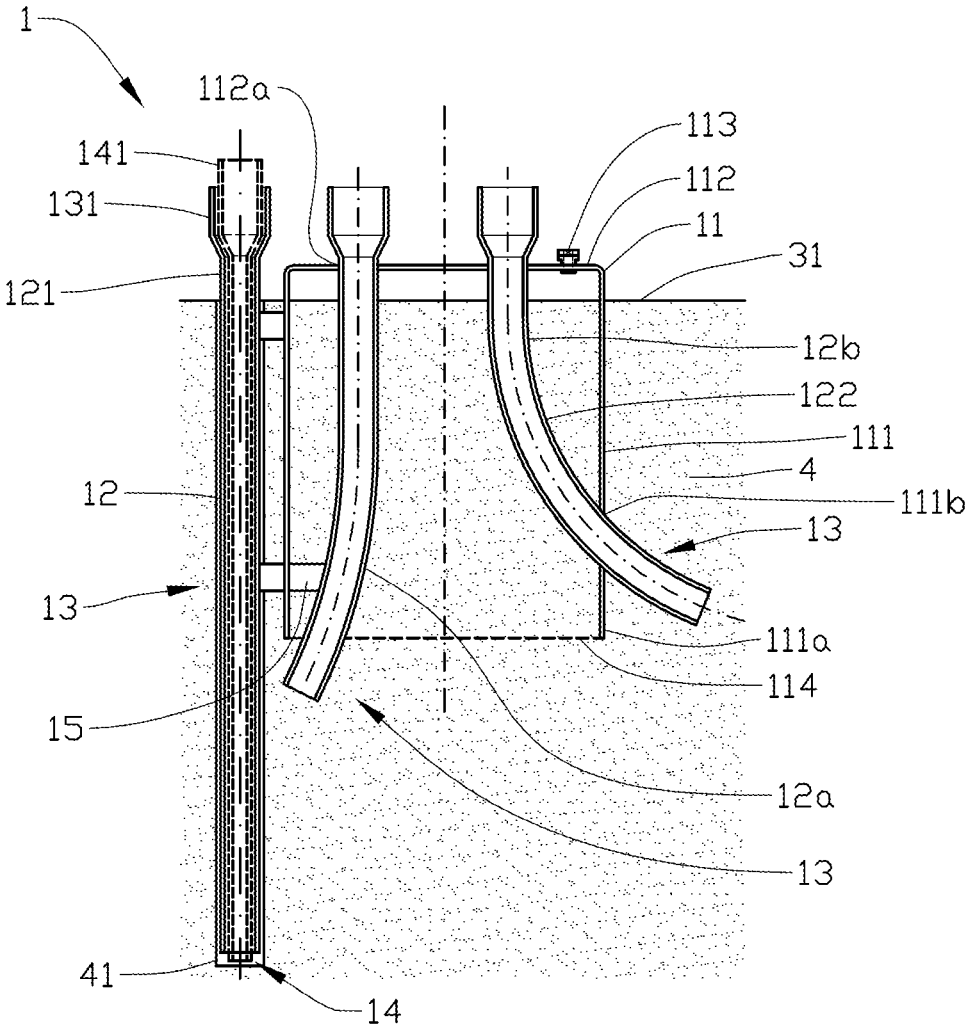
FIG. 1 shows an axial section through a cylinder-shaped suction foundation, in which several pipes in the form of the upper portions of conductor casings are attached to the suction foundation, a straight conductor casing being attached to the outside of the suction foundation and extending down below the skirt edge of the suction foundation through a predrilled hole in an unconsolidated mass, a slightly deflected conductor casing being attached internally in the suction foundation and extending beyond the lower skirt edge of the suction foundation, whereas a greatly deflected conductor casing is attached in the side wall of the suction foundation and extends out from said side wall, and in which a well pipe which extends through one of the conductor casings is indicated in broken lines.
Figure 2:
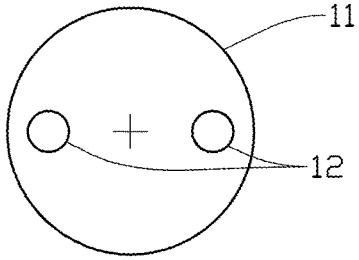
FIG. 2 shows a simplified plan view, on a smaller scale, of a cylinder-shaped suction foundation with pipes arranged inside the periphery of the suction foundation.
Figure 5:
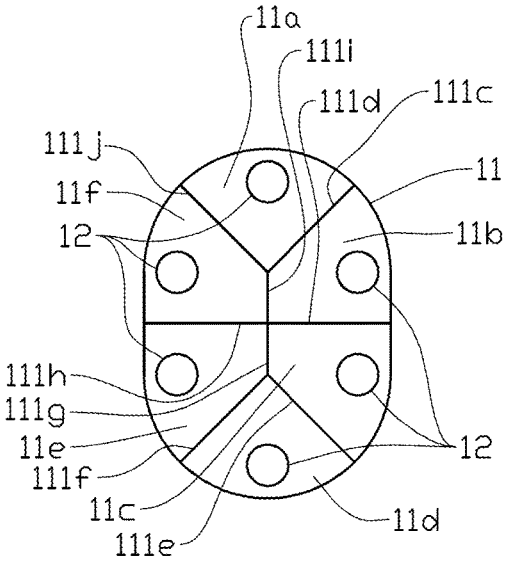
FIG. 5 shows a simplified plan view of an oval suction foundation with pipes arranged inside the periphery of the suction foundation.

Reference is first made to FIG. 1, in which the reference numeral 1 indicates a suction foundation provided with a cylindrical housing 11 forming a wall 111, also called a skirt. The housing 11 has an open bottom 114 defined by a lower wall edge 111*a*, also called a skirt edge. The housing 11 has a top, which is closed by means of a top cover 112. Several pipes 12, 12*a*, 12*b* extend downwards from above the top of the suction foundation 1. A straight first pipe 12 is attached to the outside of the housing 11; a slightly deflected second pipe 12*a* extends through an opening 112*a* in the top cover 112 and through the housing 11 and has its mouth at the skirt edge 111*a*. Said second pipe 12*a* is supported against the wall 111 by means of a pipe mount 15. A greatly deflected third pipe 12*b* extends through the housing 11 to an opening 111*b* in the wall 111 where said pipe 12*b* is attached and fits tightly against the periphery of the wall opening 111*b*. The top cover 112 fits tightly against the second and third pipes 12*a*, 12*b*. All the pipes 12, 12*a*, 12*b* have a straight upper pipe portion 121 arranged parallel to the center axis of the housing 11. The deflected pipes 12*a*, 12*b* include a curved lower pipe portion 122.

The skirt 111 and pipes 12, 12*a*, 12*b* of the suction foundation 1 have substantially been driven down into an unconsolidated mass 4 forming a seabed 31.

In a manner known per se, a negative pressure may be created inside the housing 11 when the suction foundation 1 is standing on the seabed 31 by the housing 11 being evacuated of water through a suction-line connection 113. Thereby the suction foundation 1 is driven down into the unconsolidated mass 4 by the pressure from an overlying water mass.

Each of the pipes 12, 12*a*, 12*b* forms at least an upper portion of a respective conductor casing 13 projecting with an upper portion 131 up above the suction foundation 1 in order to form a low-pressure wellhead housing in a manner known per se and also a seat for landing the upper portion 141 (indicated in broken lines in the straight pipe 12) of a well pipe 14, that is to say a high-pressure barrier. The conductor casing 13 extends beyond the periphery of the housing 11; that is to say, below the skirt edge 111*a* of the housing 11 or out from the wall 111 of the housing 11.

The conductor casing 13 forms a stable boundary of a borehole in the top part of the unconsolidated mass 4 in a manner known per se. When establishing a well, the length of the conductor casing 13 is determined according to the properties of the unconsolidated mass 4, especially with a view to preventing washouts during the subsequent drilling through the unconsolidated mass 4 and the installation of a well pipe 14. There is therefore often a need to use conductor casings 13 extending out from the suction foundation 1. In FIG. 1, this is illustrated to different degrees from the three conductor casings 13 shown.

It may be an advantage to form a borehole 41, which can accommodate the lengthened conductor casing 13 before the suction foundation 1 is put down on the seabed 31.

A further extension of the conductor casings 13, may be carried out, for example, by telescopic conductor-casing sections (not shown) being driven down through the integrated portions of the conductor casings 13. The establishing of the complete wellbore by drilling and installing well pipes 14 happens in the ordinary way through the established conductor casings 13.

The installation may be carried out as shown in FIGS. 7*a*-7*c*, 8*a*-8*c* and 9*a*-9*c*.

Figure 7A:
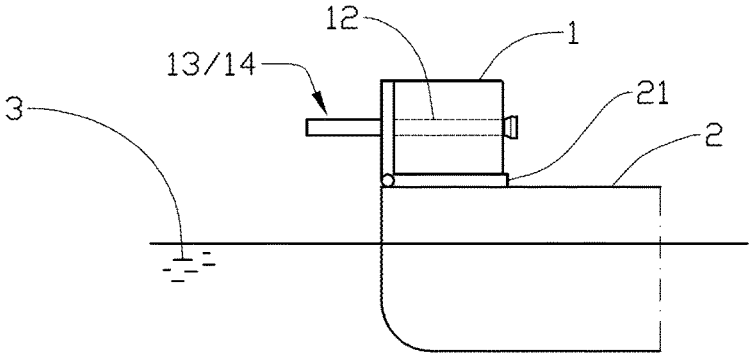
FIGS. 7*a-c* show principle drawings, in side views, of the deployment of a suction foundation with a projecting portion of a conductor casing, FIG. 7*a* showing the suction foundation in a horizontal position during transport on a vessel, FIG. 7*b* showing the suction foundation in an upright position on a framework projecting from the vessel, and FIG. 7*c* showing the suction foundation hanging from a lifting device, in the process of being lowered into a water mass.
Figure 7B:
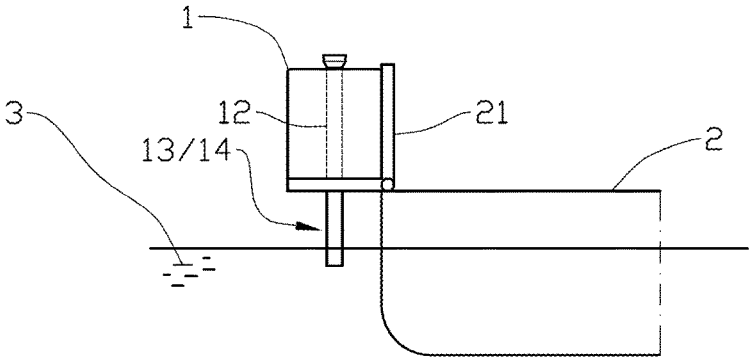
Figure 7C:
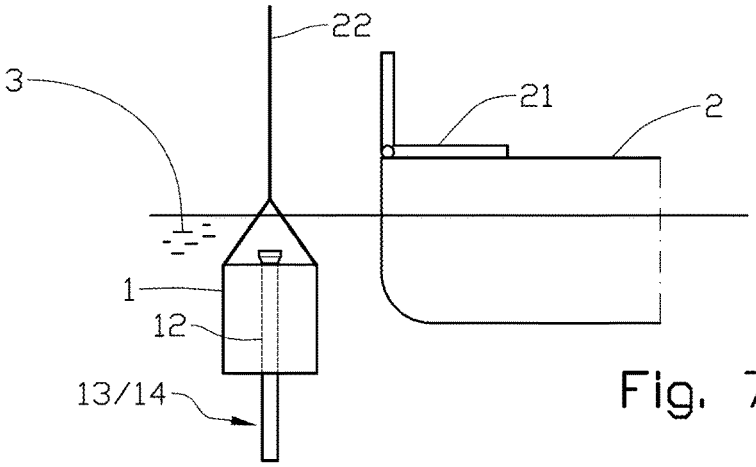

FIG. 7*a* shows a suction foundation 1 with a conductor casing 13 that extends out of the suction foundation 1. Because of that, it is transported in a lying position on a shiftable framework 21 on a vessel 2. When the suction foundation 1 is to be put down on the seabed 31, the suction foundation 1 is put into the upright position by means of the framework 21, see FIG. 7*b*. Then the suction foundation 1 is connected to a lifting device 22, typically a crane, and lowered through a water mass 3 to the seabed 31 where the suction foundation 1 with the conductor casing 13 is driven down into the unconsolidated mass 4, after which the well is established through the suction foundation 1.

Figure 8A:
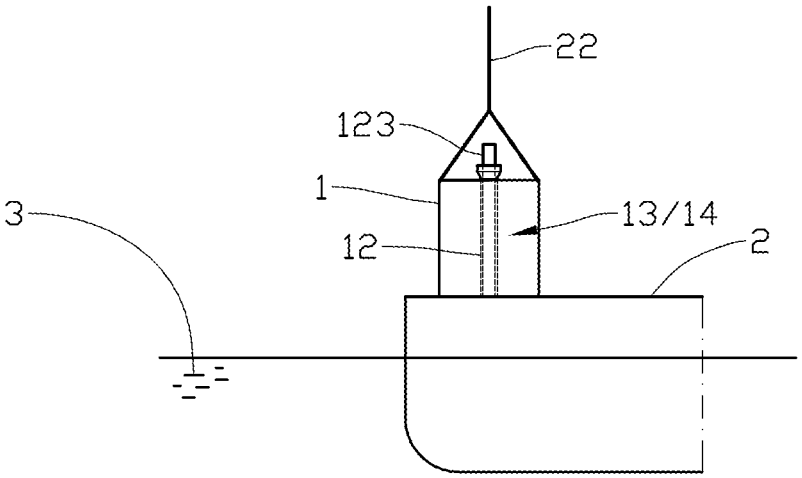
FIGS. 8*a-c* show principle drawings, in side views, of the deployment of a suction foundation with a telescopically lengthenable portion of the conductor casing, FIG. 8*a* showing the suction foundation with a retracted conductor casing during transport on the vessel, FIG. 8*b* showing the suction foundation hanging from the lifting device before the conductor casing has been extended, and FIG. 8*c* showing the suction foundation after the conductor casing has been extended and the suction foundation is in the process of being lowered into the water mass.
Figure 8B:
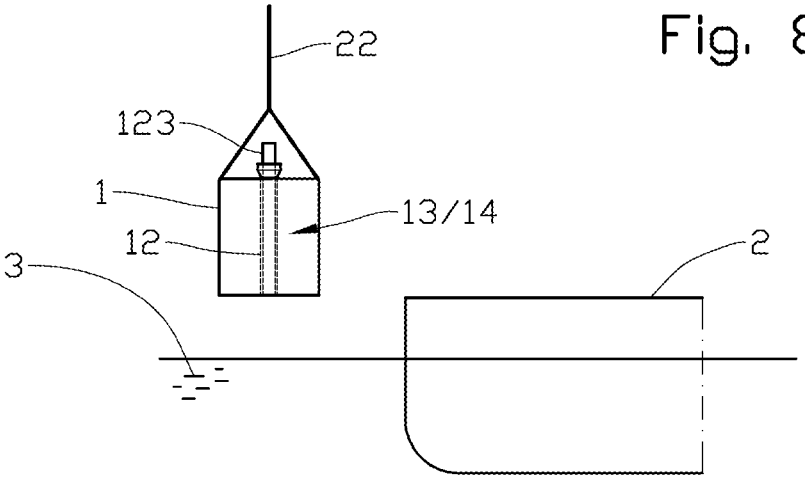
Figure 8C:
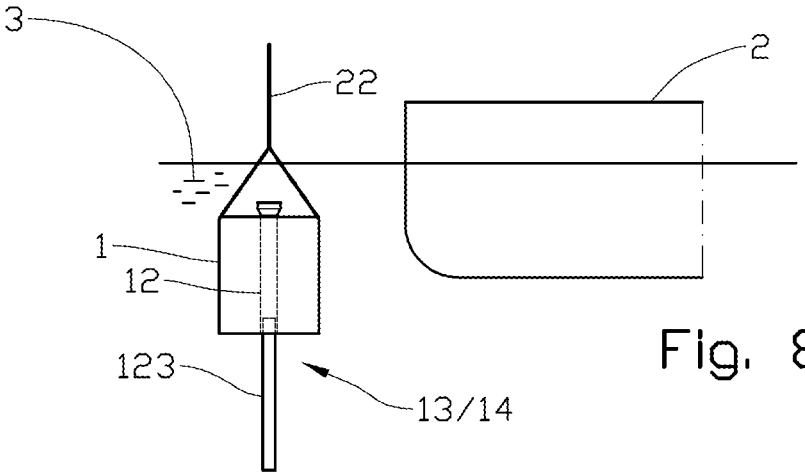

FIGS. 8*a*-8*c* correspondingly show a suction foundation 1 with a telescopic conductor casing 13 which is retracted during the transport of the suction foundation 1, but which is lengthened, after the suction foundation 1 has been lifted up from the vessel 2, by a telescope section 123 being released from its retracted position and then secured to the center pipe 12 in its extended position. Alternatively, the telescopic conductor casing 13 may be lengthened while the suction foundation 1 is standing on a framework 21 as shown in FIGS. 9*a*-9*c*.

Figure 9A:
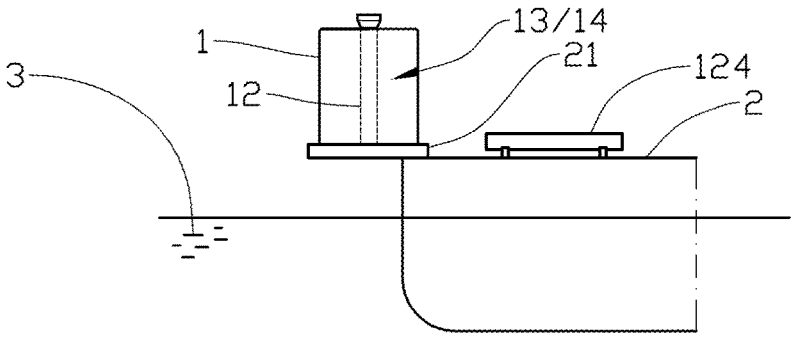
FIGS. 9*a-c* show principle drawings, in side views, of the deployment of a suction foundation with a portion of the conductor casing which is lengthened by joining before the suction foundation is lowered into the water mass, FIG. 9*a* showing a pipe section lying on the vessel and the suction foundation standing on a framework projecting from the vessel, FIG. 9*b* showings the suction foundation standing on the framework and being connected to the lifting device prepared for lowering into the water mass, the conductor casing having been lengthened with the pipe section, and FIG. 9*c* showing the suction foundation in the process of being lowered into the water mass.
Figure 9B:
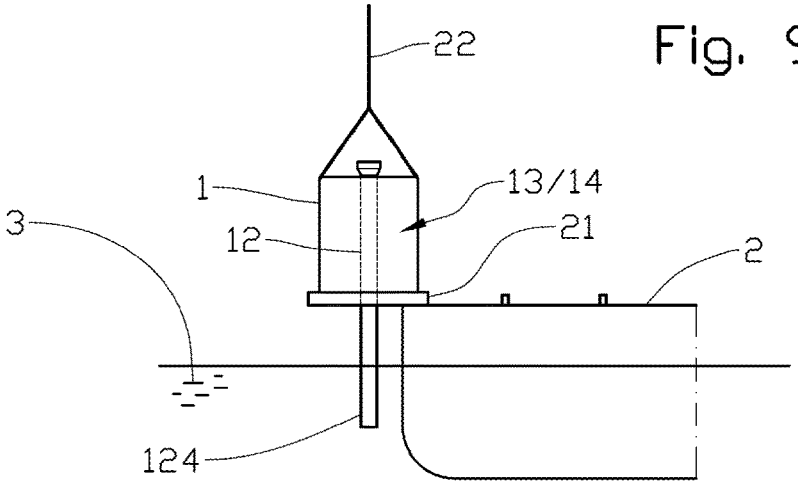
Figure 9C:
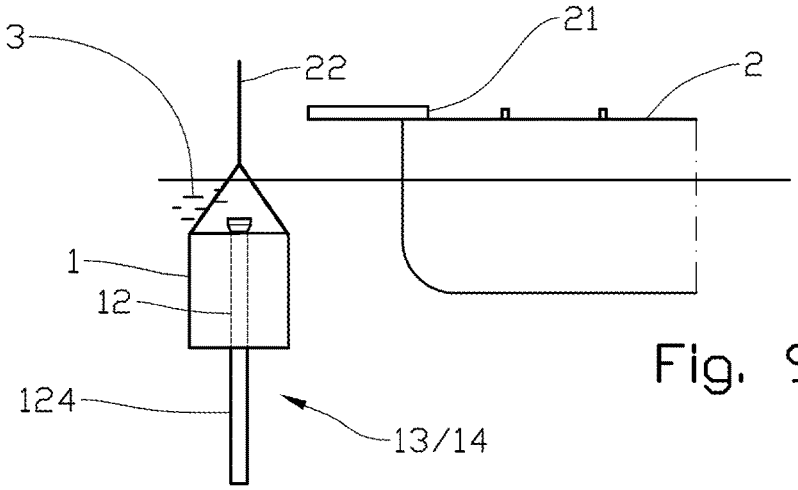

FIGS. 9*a*-9*c* show an embodiment in which the center pipe 12 is having a pipe section 124 joined to it, which, during transport of the suction foundation 1, is separate from the suction foundation 1, indicated in FIG. 9*a* as lying on the vessel 2. The joining takes place while the suction foundation 1 is standing on a framework 21 projecting from the vessel 2.

Figure 3:
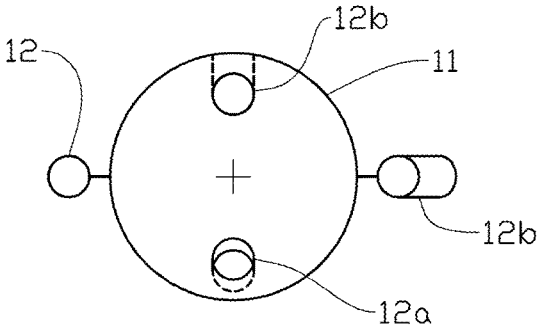
FIGS. 3 and 4 show simplified plan views of a cylinder-shaped suction foundation with pipes arranged inside and outside the periphery of the suction foundation.
Figure 6:
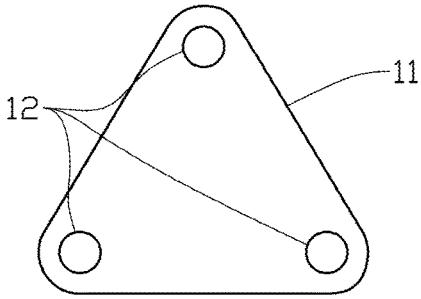
FIG. 6 shows a simplified plan view of a triangle-shaped suction foundation with pipes arranged near the corners of the suction foundation and inside the periphery of the suction foundation.
Figure 4:
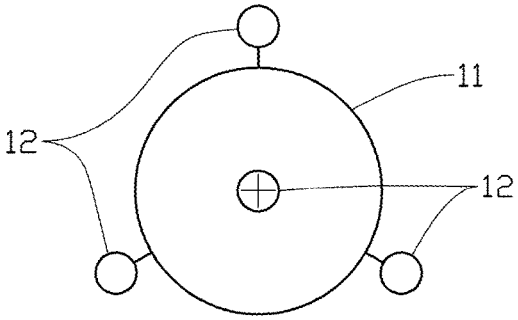

FIGS. 2-6 show examples of suction foundations 1 having different ground plans and positionings of integrated pipes 12 inside and outside the periphery of the housing 11. In FIG. 3, several pipes 12, 12*a*, 12*b* having different deflections outwards from the center axis of the suction foundation 1 are indicated. In FIG. 6, the housing is divided into several chambers 11*a*-11*f* by means of internal walls 111*c*-111*j*. Each chamber is preferably provided with a suction-line connection 113 (see FIG. 1) for the negative pressure of each chamber 11*a*-11*f* to be adjustable independently of the negative pressures of the other chambers 11*a*-11*f*. At least some of the chambers may be provided with means not shown, typically sensors that can be connected to a remote control system not shown, for recording pressures and the occurrence of gases.

The suction foundation 1 may be provided with means, not shown, for registering verticality.

The suction foundation 1 may also be provided with arrangements not shown, typically guiding elements, for receiving equipment that is to be connected to the suction foundation 1 during well establishment, well maintenance or well shut-down.

It should be noted that all the above-mentioned embodiments illustrate the invention, but do not limit it, and persons skilled in the art may construct many alternative embodiments without departing from the scope of the attached claims. In the claims, reference numbers in parentheses are not to be regarded as restrictive.

The use of the verb "to comprise" and its different forms does not exclude the presence of elements or steps that are not mentioned in the claims. The indefinite article "a" or "an" before an element does not exclude the presence of several such elements.

The fact that some features are indicated in mutually different dependent claims does not indicate that a combination of these features cannot be used with advantage.

The invention claimed is:

1. A wellhead foundation for one or more subsea wells, the wellhead foundation comprising:

a suction foundation provided with a housing with an open bottom and a top which is closable with a top cover, and one or more pipes being attached to the housing and extending from the top of the housing and at least over a substantial part of the vertical extent of the housing and away from the housing at least in a vertical direction, wherein a straight upper portion of each pipe projects up above the top of the housing and forms an upper conductor-casing portion which is arranged to receive an upper well-pipe portion and forms part of a low-pressure barrier in the well, wherein the straight upper pipe portion of each pipe is arranged parallel to the center axis of the housing; and wherein a deflected pipe extends through the top cover and through a wall opening in the housing, and wherein the wall opening fits tightly against the periphery of the deflected pipe.

2. The wellhead foundation according to claim 1, wherein the straight upper pipe portion of said pipe is arranged eccentrically in the suction foundation with respect to a center axis of the housing.

3. The wellhead foundation according to claim 1, wherein the deflected pipe extends through the top cover and beyond a skirt edge of the housing.

4. The wellhead foundation according to claim 1, wherein the pipe is lengthenable.

5. The wellhead foundation according to claim 4, wherein the pipe is telescopingly lengthenable via one or more telescope sections.

6. The wellhead foundation according to claim 4, wherein the pipe is joinably lengthenable via one or more pipe sections.

7. The wellhead foundation according to claim 1, wherein several pipes are distributed at least one of inside and outside the periphery of the housing.

8. The wellhead foundation according to claim 1, wherein at least one straight pipe or another deflected pipe is arranged outside the periphery of the housing.

9. A wellhead foundation for one or more subsea wells, the wellhead foundation comprising:

a suction foundation provided with a housing with an open bottom and a top which is closable with a top cover, and one or more pipes being attached to the housing and extending from the top of the housing and at least over a substantial part of the vertical extent of the housing and away from the housing at least in a vertical direction, wherein a straight upper portion of each pipe projects up above the top of the housing and forms an upper conductor-casing portion which is arranged to receive an upper well-pipe portion and forms part of a low-pressure barrier in the well, wherein the straight upper pipe portion of each pipe is arranged parallel to the center axis of the housing; and wherein the housing is provided with several internal walls forming several separate chambers which are each provided with a suction-line connection.

10. The wellhead foundation according to claim 9, wherein the straight upper pipe portion of said pipe is arranged eccentrically in the suction foundation with respect to a center axis of the housing.

11. The wellhead foundation according to claim 9, wherein a deflected pipe extends through the top cover and beyond a skirt edge of the housing.

12. The wellhead foundation according to claim 9, wherein the pipe is lengthenable.

13. The wellhead foundation according to claim 9, wherein the pipe is telescopingly lengthenable via one or more telescope sections.

14. The wellhead foundation according to claim 9, wherein the pipe is joinably lengthenable via one or more pipe sections.

15. The wellhead foundation according to claim 9, wherein several pipes are distributed at least one of inside and outside the periphery of the housing.

16. The wellhead foundation according to claim 9, wherein at least one straight pipe or deflected pipe is arranged outside the periphery of the housing.

* * * * *